US008387965B2

(12) United States Patent
Borsuk et al.

(10) Patent No.: US 8,387,965 B2
(45) Date of Patent: Mar. 5, 2013

(54) STAPLER SYSTEM FOR AN IMAGE FORMING APPARATUS

(75) Inventors: John Edward Borsuk, Nicholasville, KY (US); Jie Chen, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 98 days.

(21) Appl. No.: 12/982,987

(22) Filed: Dec. 31, 2010

(65) Prior Publication Data

US 2012/0169005 A1 Jul. 5, 2012

(51) Int. Cl.
*B65H 37/04* (2006.01)

(52) U.S. Cl. ..... 270/58.11; 270/58.08; 270/58.13; 399/410

(58) Field of Classification Search ..... 270/58.08, 270/58.11, 58.12, 58.13; 399/407, 410, 124
See application file for complete search history.

(56) References Cited

U.S. PATENT DOCUMENTS 6,581,922 B2 * 6/2003 Kuwata et al. ..... 270/58.11
6,722,646 B2 * 4/2004 Sekiyama et al. ..... 270/58.09
6,886,828 B2 * 5/2005 Saito ..... 271/225
7,172,186 B2 * 2/2007 Saito et al. ..... 270/58.08
7,258,339 B2 * 8/2007 Fukatsu et al. ..... 271/220
2002/0109283 A1 * 8/2002 Hasegawa et al. ..... 270/58.08
2004/0042026 A1 * 3/2004 Guillemin Franco et al. ..... 358/1.12
2012/0027484 A1 * 2/2012 Wang et al. ..... 399/410

FOREIGN PATENT DOCUMENTS

TW 201205210 * 2/2012

* cited by examiner

*Primary Examiner* — Patrick Mackey
(74) *Attorney, Agent, or Firm* — Justin M Tromp

(57) ABSTRACT

A stapler system for an image forming apparatus according to one example embodiment includes a housing and a mounting device for mounting the housing to the image forming apparatus. A staple head is positioned within the housing for stapling media. A media sheet path is disposed within the housing for directing media received from the image forming apparatus to the staple head for stapling. When the housing is mounted on the image forming apparatus, a portion of the housing extends above an output bin of the image forming apparatus to permit delivery of stapled media from the housing to the output bin of the image forming apparatus.

25 Claims, 13 Drawing Sheets

STAPLER SYSTEM FOR AN IMAGE FORMING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to the handling of printed media sheets by an image forming apparatus, and more specifically, to a stapler system for an image forming apparatus.

2. Description of the Related Art

An image forming apparatus may be equipped with a stapler system for stapling printed media sheets. Typically, such stapler systems are equipped with an output tray for collecting stapled media sheets separate from an output bin of the printer. An advanced image forming apparatus, such as a multi-function printer (MFP), may be equipped with copying and/or scanning functionality in addition to the printing functionality. In some MFPs, the output bin of the stapler system is on a top portion of the MFP above the output bin of the printer. This increases the overall height of the MFP and makes it undesirable for use in places with space limitations. Further, the increased height may also create accessibility problems for the stapled media sheets. Accordingly, it will be appreciated that a stapler system that does not increase the overall height of an MFP or create accessibility problems is desired.

SUMMARY OF THE DISCLOSURE

A stapler system for an image forming apparatus according to one example embodiment includes a housing and a mounting device for mounting the housing to the image forming apparatus. A staple head is positioned within the housing for stapling media. A media sheet path is disposed within the housing for directing media received from the image forming apparatus to the staple head for stapling. When the housing is mounted on the image forming apparatus, a portion of the housing extends above an output bin of the image forming apparatus to permit delivery of stapled media from the housing to the output bin of the image forming apparatus. In some embodiments, when the housing is mounted on a multi-function image forming apparatus having a base portion for printing, a scanner portion for scanning and a gap formed between the base portion and the scanner portion and having the output bin positioned in the gap, the portion of the housing extends into the gap and above the output bin.

Embodiments include those wherein the housing has a generally L-shaped structure formed by a first portion and a second portion extending in a generally orthogonal direction from the first portion. In such embodiments, the mounting device is positioned on the first portion and a media release mechanism is positioned on the second portion for delivering stapled media from the housing to the output bin of the image forming apparatus. The media release mechanism is positioned above the output bin of the image forming apparatus when the housing is mounted on the image forming apparatus.

In some embodiments, the mounting device includes a movable latch member for securing the housing to the image forming apparatus. The latch member is received by a corresponding opening in the image forming apparatus when the housing is mounted on the image forming apparatus. Some embodiments include a pin adjacent to the latch member for aligning the housing with the image forming apparatus. The pin is received by a corresponding hole in the image forming apparatus when the housing is mounted on the image forming apparatus. In some embodiments, the mounting device includes an actuating mechanism having a latch that is operatively coupled to the latch member. Pressing the latch releases the latch member from the locked position and permits removal of the housing from the image forming apparatus.

BRIEF DESCRIPTION OF THE DRAWINGS

The above-mentioned and other features and advantages of this disclosure, and the manner of attaining them, will become more apparent and the disclosure will be better understood by referencing the following description of embodiments of the disclosure taken in conjunction with the accompanying drawings, wherein.

DETAILED DESCRIPTION

Figure 1:
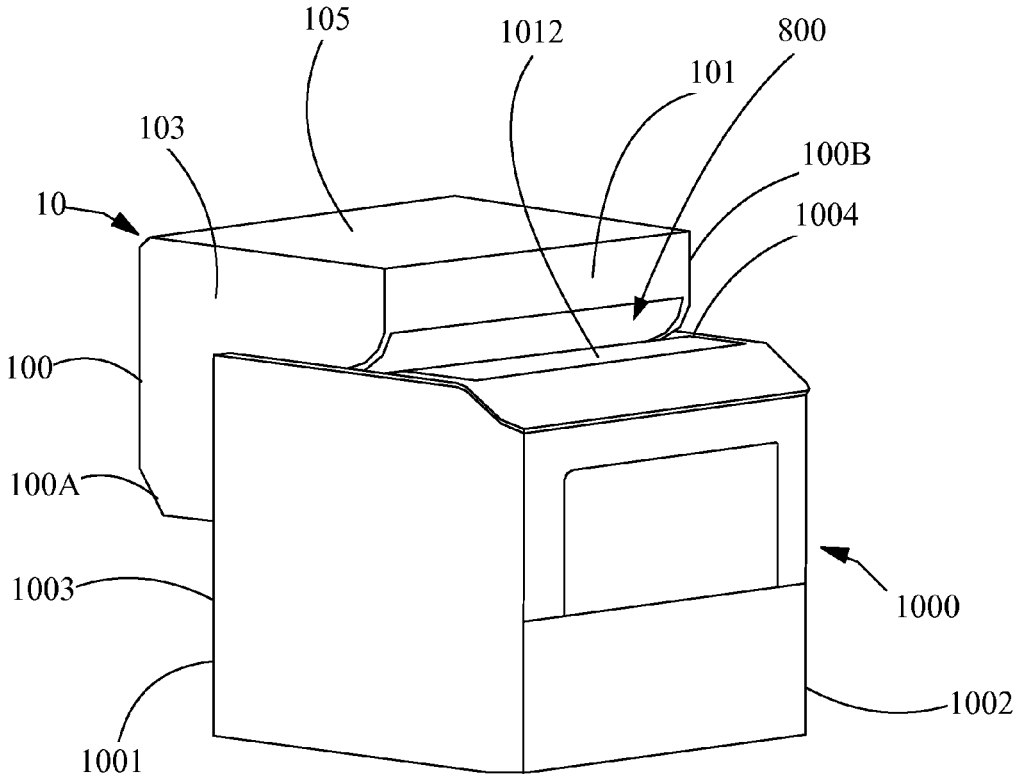
FIG. 1 is a perspective view of a stapler system mounted on a single function image forming apparatus according to one example embodiment.

The following description and drawings illustrate embodiments sufficiently to enable those skilled in the art to practice it. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense, and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure provides a stapler system for an image forming apparatus, such as a printer. The stapler system of the present disclosure may be used in conjunction with a single function printer (SFP) or a multi-function printer (MFP). The stapler system shares an output bin of the image forming apparatus for collecting a stack of stapled media sheets therein.

Figure 2:
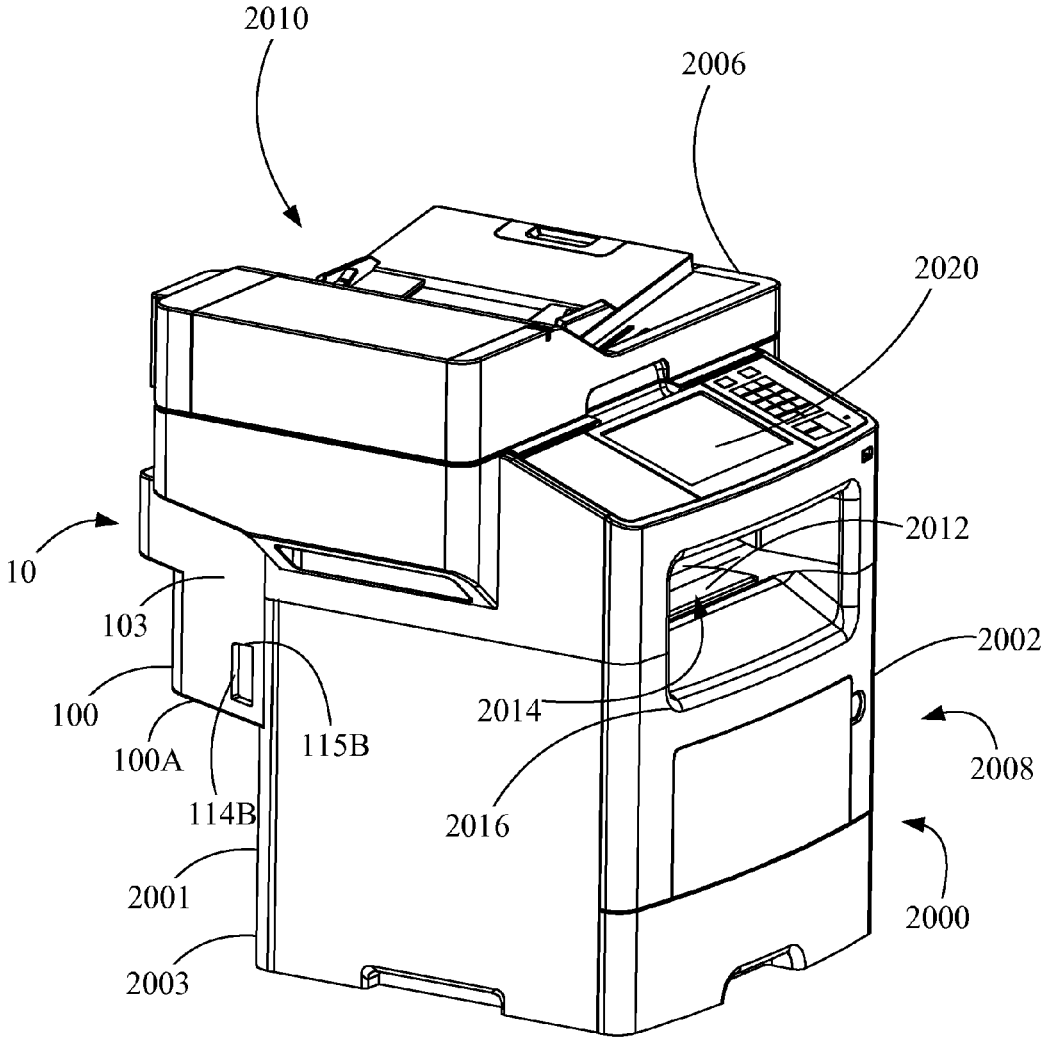
FIGS. 2 and 3 are perspective views of a stapler system mounted on a multi-function image forming apparatus according to one example embodiment.
Figure 3:
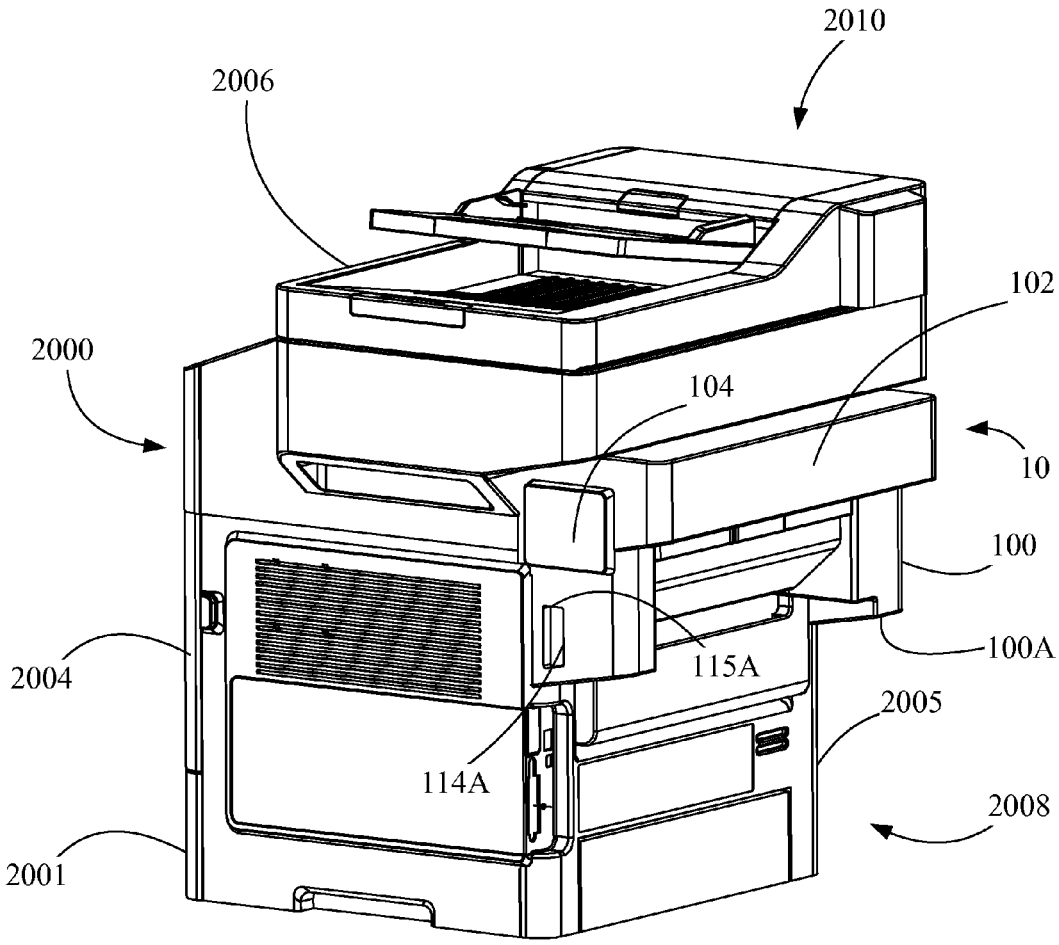

Referring now to FIGS. 1 through 3, perspective views of a stapler system 10 mounted on image forming apparatuses 1000 and 2000 are shown. As illustrated in FIG. 1, image forming apparatus is a single function printer (SFP) 1000 and in FIGS. 2 and 3 image forming apparatus is a multi-function printer (MFP) 2000. Stapler system 10 includes a housing 100. Housing 100 includes a first portion 100A and a second portion 100B that extends generally orthogonally from, and is integral with, first portion 100A. Accordingly, first and second portions 100A, 100B form a generally L-shaped structure.

With reference to FIG. 1, image forming apparatus 1000 includes a housing 1001 formed by a front wall 1002, a first side wall 1003, a second side wall (not shown) and a rear wall (not shown). Housing 1001 also includes a top portion 1004 and a bottom portion (not shown). Top portion 1004 includes an output bin 1012 for collecting printed media sheets from image forming apparatus 1000. Housing 100 of stapler system 10 is carried by housing 1001 of image forming apparatus 1000. First portion 100A of housing 100 mounts on at least one of the walls of image forming apparatus 1000. In the example embodiment illustrated, first portion 100A mounts on the rear wall of image forming apparatus 1000 as will be explained in greater detail herein. However, it will be appreciated that first portion 100A may mount on one or both of the side walls or front wall 1002 of image forming apparatus 1000. Further, second portion 100B of housing 100 may mount to a section of top portion 1004 as desired. Second portion 100B of housing 100 extends directly above output bin 1012 of image forming apparatus 1000 to permit delivery of stapled media sheets from stapler system 10 to output bin 1012 as will be explained in greater detail herein. Second portion 100B of housing 100 includes a media release mechanism 800 positioned above output bin 1012 when housing 100 is mounted on image forming apparatus 1000 that releases stapled media from housing 100 and delivers it to output bin 1012 as will be explained in greater detail herein.

With reference to FIGS. 2 and 3, image forming apparatus 2000 includes a is housing 2001 formed by a front wall 2002, a first side wall 2003, a second side wall 2004, a rear wall 2005, a top portion 2006 and a bottom portion (not shown). Image forming apparatus 2000 includes a base portion 2008 for printing media sheets and a scanner portion 2010 positioned above base portion 2008 for scanning media sheets. An output bin 2012 is located in a gap 2014 between base portion 2008 and scanner portion 2010 for collecting printed media sheets from base portion 2008. In the example embodiment illustrated, a first window 2016 extends through front wall 2002 to allow access to the printed media sheets. Alternatives include those wherein window 2016 extends through one of side walls 2003, 2004 or rear wall 2005.

Housing 100 of stapler system 10 is carried by housing 2001 of image forming apparatus 2000. First portion 100A of housing 100 mounts on at least one of the walls of image forming apparatus 2000. In the example embodiment illustrated, first portion 100A mounts on rear wall 2005 as will be explained in greater detail herein. However, it will be appreciated that first portion 100A may mount on one or both of side walls 2003, 2004 or front wall 2002 of image forming apparatus 2000. Second portion 100B of housing 100 extends through a second window in housing 2001 directly above output bin 2012 of image forming apparatus 2000 to permit delivery of stapled media sheets from stapler system 10 to output bin 2012 as will be explained in greater detail herein. In the example embodiment illustrated, second portion 100B extends through a second window positioned opposite window 2016 through rear wall 2005. However, second portion 100B may extend through a window in any of walls 2002, 2003, 2004, 2005. Further, second portion 100B may mount to a portion of housing 2001 inside gap 2014. In this embodiment, media release mechanism 800 is positioned in gap 2014 above output bin 2012 when housing 100 is mounted on image forming apparatus 2000.

Figure 4:
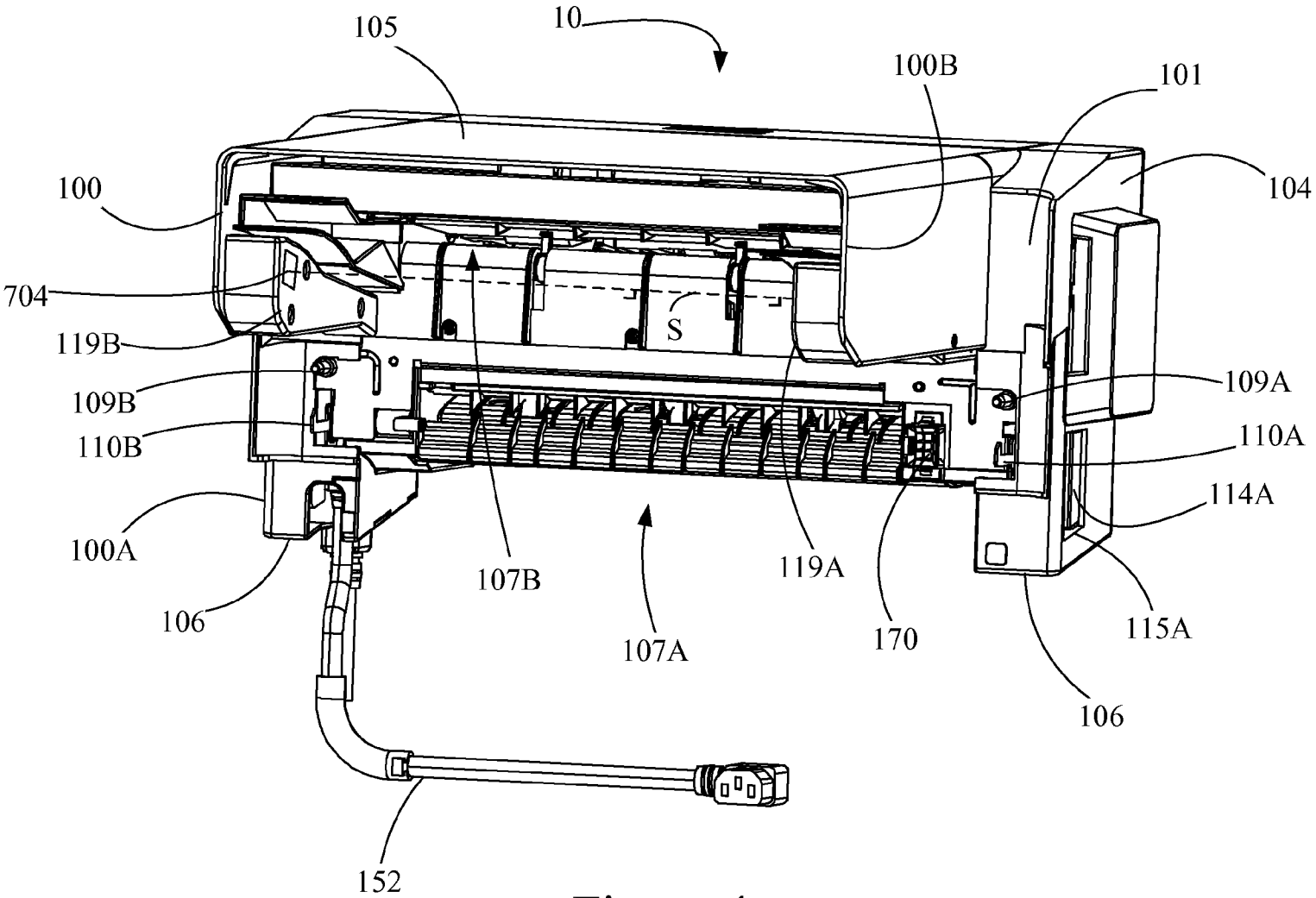
FIG. 4 is a perspective view of a stapler system according to one example embodiment.
Figure 5:
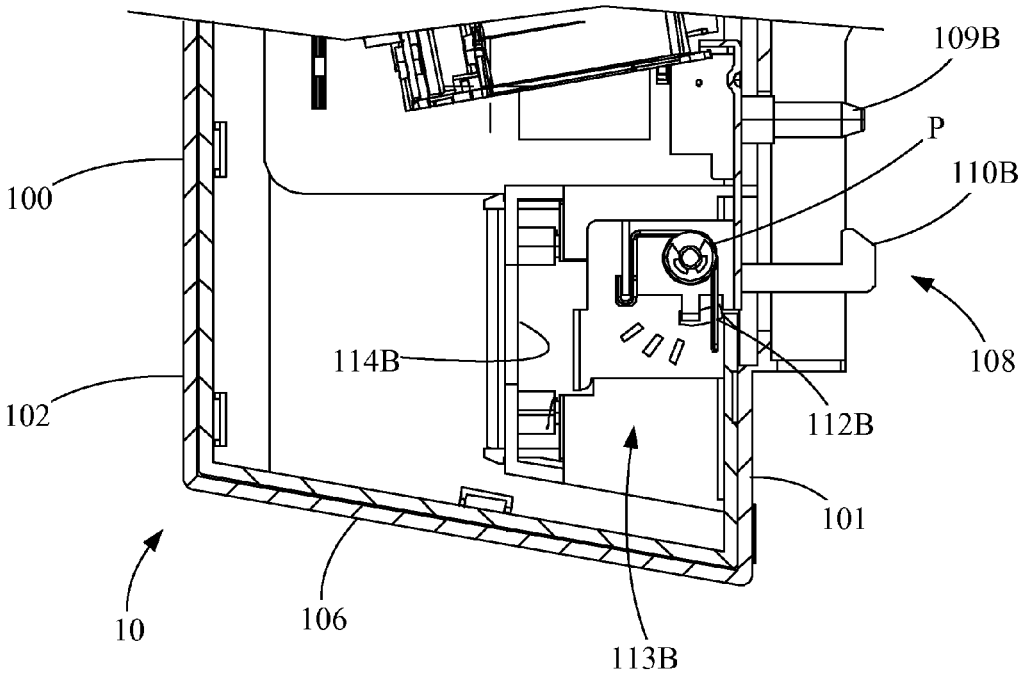
FIG. 5 is a cross-sectional view of a mounting device for a stapler system housing according to one example embodiment.

Referring to FIGS. 4 and 5, housing 100 includes a front portion 101, a rear portion 102, a pair of side portions 103 (FIG. 2), 104, a top portion 105 and a bottom portion 106. Housing 100 also includes a media sheet entrance 107A and a media sheet exit 107B. When housing 100 is mounted on image forming apparatus 1000, 2000, front portion 101 faces a wall, such as the rear wall, of housing 1001, 2001 of image forming apparatus 1000, 2000 and rear portion 102 faces away from housing 1001, 2001. A mounting device 108 is positioned on front portion 101 for mounting housing 100 on housing 1001, 2001 of image forming apparatus 1000, 2000. Mounting device 108 includes a pair of pins 109A, 109B and a pair of latch members 110A, 110B each disposed at opposite ends of front side 101 of housing 100. Pins 109A, 109B are received by corresponding holes in housing 1001, 2001 and align housing 100 of stapler system 10 relative to housing 1001, 2001 of image forming apparatus 1000, 2000. In the example embodiment illustrated, pins 109A, 109B are generally cylindrical members each having a tapered end portion to ease the insertion of pins 109A, 109B into the corresponding holes of housing 1001, 2001. Latch members 110A, 110B are received by corresponding openings, such as slots, in housing 1001, 2001 of image forming apparatus 1000, 2000 and secure housing 100 of stapler system 10 to housing 1001, 2001. To mount housing 100 on housing 1001, 2001, a user aligns pins 109A, 109B and latch members 110A, 110B with the corresponding holes and slots in housing 1001, 2001 and simply pushes housing 100 toward housing 1001, 2001 until a pair of catches of housing 1001, 2001 engage latch members 110A, 110B. The engagement between latch member 110A, 110B and the catches of housing 1001, 2001 secures housing 100 of stapler system 10 to housing 1001, 2001 of image forming apparatus 1000, 2000. Biasing members 112A, 112B bias latch members 110A, 110B to a locked position wherein latch members 110A, 110B are engaged with and retained by the catches. In the example embodiment illustrated, biasing members 112A, 112B are torsion springs; however, any suitable biasing member may be used as desired including, for example, compression springs.

Mounting device 108 further includes a pair of actuating mechanisms 113A, 113B operatively coupled to latch members 110A, 100B for releasing latch members 110A, 110B and thereby releasing housing 100 from housing 1001, 2001. Actuating mechanisms 113A, 113B include latches 114A, 114B, respectively, disposed on side portions 103, 104, respectively, of housing 100. Latches 114A, 114B are operatively coupled to latch members 110A, 110B. In the example embodiment illustrated, latches 114A, 114B are positioned within recesses 115A, 115B, respectively, and face housing 1001, 2001 when housing 100 is mounted thereon. This configuration achieves an ergonomic effect in that as a user removes housing 100 from housing 1001, 2001, latches 114A, 114B are positioned to be conveniently accessible to the user's fingertips. Alternatives include those wherein latches 114A, 114B face in opposite directions from each other from sides 103, 104 and those wherein latches 114A, 114B face away from housing 1001, 2001. Pressing latches 114A, 114B causes latch members 110A, 110B to rotate about a pivot point 'P' in order to provide clearance for latch members 110A, 110B to clear the catches of housing 1001, 2001 and to allow removal of housing 100.

Figure 6:
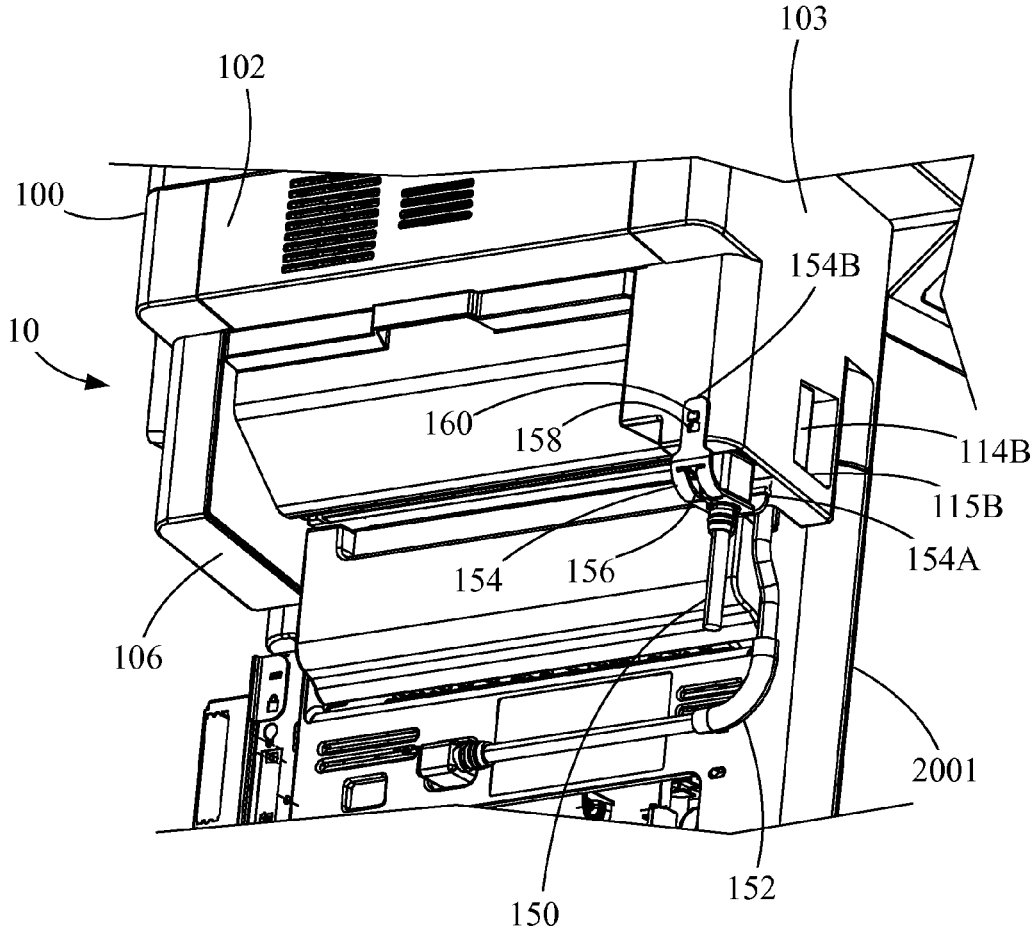
FIG. 6 is a perspective view of an electrical power arrangement for a stapler system mounted on an image forming apparatus according to one example embodiment.

With reference to FIGS. 4 and 6, in the example embodiment illustrated, is stapler system 10 receives electrical power directly from a power supply (not shown). Alternatives include those wherein stapler system 10 receives electrical power from image forming apparatus 1000, 2000. In the example embodiment illustrated, power is supplied to stapler system 10 via a power cord 150 (FIG. 6) from the power source through an inlet in bottom portion 106. Alternatives include those wherein the inlet for power cord 150 is on one of side portions 103, 104, rear portion 102 or top portion 105. In the example embodiment illustrated, electrical power received from cord 150 is split between stapler system 10 and image forming apparatus 1000, 2000. Alternatives include those wherein image forming apparatus 1000, 2000 has its own power supply. A power cord 152 transfers electrical power from an outlet on bottom portion 106 to an inlet on image forming apparatus 1000, 2000. Alternatives include those wherein the outlet for power cord 152 is on one of side portions 103, 104, rear portion 102 or top portion 105 of housing 100.

Housing 100 includes a retaining member 154 for retaining power cord 150 on housing 100. Retaining member 154 is composed of a flexible material such as, for example, rubber. Retaining member 154 includes an opening 156 therein, such as a slit, for receiving power cord 150. A first end 154A of retaining member 154 is attached to bottom portion 106 of housing 100. A second end 154B of retaining member 154 is removably attached to rear portion 102 of housing 100. Second end 154B includes an opening 158 therein for receiving a peg 160 extending from rear portion 102 to attach second end 154B to housing 100. Alternatives include those wherein peg 160 extends from bottom portion 106 or one of side portions 103, 104 and second end 154B of retaining member 154 attaches to bottom portion 106 or one of side portions 103, 104.

Housing 100 also includes a data bus 170 (FIG. 4) for exchanging data between stapler system 10 and image forming apparatus 1000, 2000 as is known in the art. In some embodiments, stapler system 10 includes a controller (not shown) for controlling the operation of stapler system 10. Alternatives include those wherein a controller of image forming apparatus 1000, 2000 controls the operation of stapler system 10.

Figure 7:
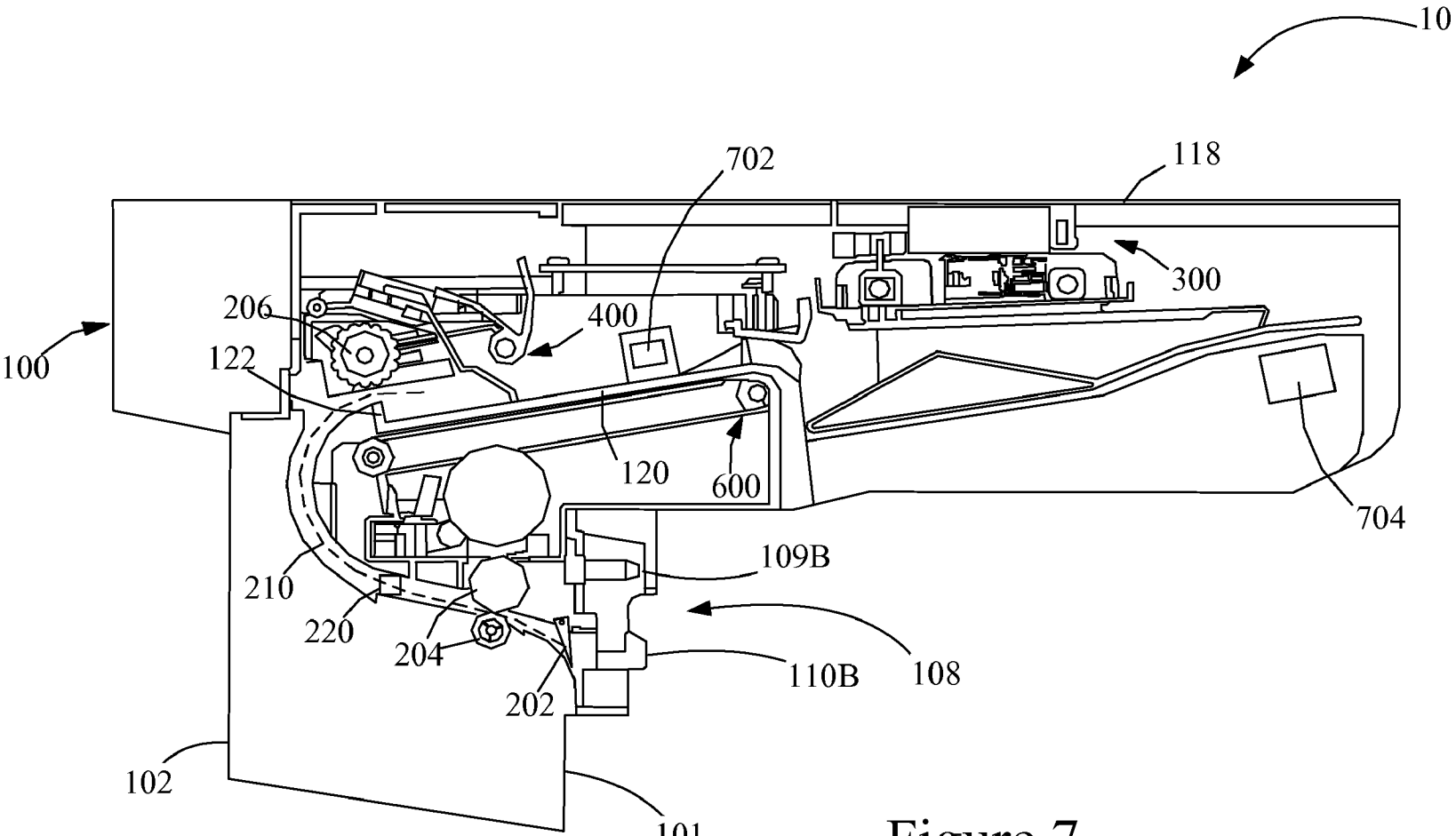
FIG. 7 is a cross-sectional side view of a stapler system according to one example embodiment.

Referring now to FIG. 7, stapler system 10 includes a plurality of guiding elements to guide media sheets received from image forming apparatus 1000, 2000, particularly printed media sheets, within housing 100. Specifically, the plurality of guiding elements operatively mount within housing 100 and guide the printed media sheets along a media sheet path 210 (shown with a dashed line) within housing 100. For example, as shown in FIG. 7, the plurality of guiding elements includes a diverter 202 for diverting media traveling along a media sheet path within image forming apparatus 1000, 2000 into media sheet entrance 107A of stapler system 10 (FIG. 4). In some embodiments, diverter 202 is mounted on housing 100 of stapler system 10. Alternatives include those wherein diverter 202 is mounted on housing 1001, 2001 of image forming apparatus 1000, 2000. The guiding elements also include a pair of feed rollers 204 and an exit roller 206 for advancing media along media sheet path 210 within housing 100.

Diverter 202 directs the printed media sheets either toward media sheet path 210 or toward an output bin of an image forming apparatus, such as output bin 1012 of image forming apparatus 1000. Specifically, diverter 202 may be instructed to block media sheet path 210 when an image forming apparatus, such as image forming apparatus 1000, 2000, is instructed to perform only a printing function. Otherwise, when the image forming apparatus is instructed to perform a stapling function along with the printing function, diverter 202 is positioned to allow the printed media sheets to leave image forming apparatus 1000, 2000 from an opening in a wall, such as, for example, the rear wall, of housing 1001, 2001 and enter media sheet entrance 107A through front portion 101 of first portion 100A of housing 100 and move along media sheet path 210 for stapling by stapler system 10. Once diverter 202 directs the printed media sheets toward media sheet path 210, feed rollers 204 and exit roller 206 advance the printed media sheets along media sheet path 210. In the example embodiment illustrated, media sheet path 210 is a generally C-shaped path.

Stapler system 10 further includes a pass through sensor 220 mounted along media sheet path 210. In the example embodiment illustrated, pass through sensor 220 is a photosensor mounted along media sheet path 210 between feed rollers 204 and exit roller 206. Alternatives include those wherein pass through sensor 220 is a mechanical flag sensor. Pass through sensor 220 determines positions of the printed media sheets along media sheet path 210. Specifically, pass through sensor 220 detects when leading and trailing edges of the printed media sheets arrive at or leave from pass through sensor 220. Based on the values of pass through sensor 220, i.e., determination of the leading edges and/or the trailing edges, stapler system 10 may operate in a predetermined sequential order, which will be explained in greater detail later herein. Pass through sensor 220 may also determine if a jam of a printed media sheet on media sheet path 210 has occurred.

As shown in FIG. 7, stapler system 10 also includes a first alignment mechanism 300 for laterally aligning the printed media sheets. First alignment mechanism 300 is operatively mounted within housing 100. Specifically, as shown in FIG.

7, first is alignment mechanism 300 is mounted on a portion 118 of housing 100 such that first alignment mechanism 300 is positioned above an output bin of an image forming apparatus. For example, as shown in FIG. 1, portion 118 of housing 100 positioned above output bin 1012 may support first alignment mechanism 300.

Figure 8:
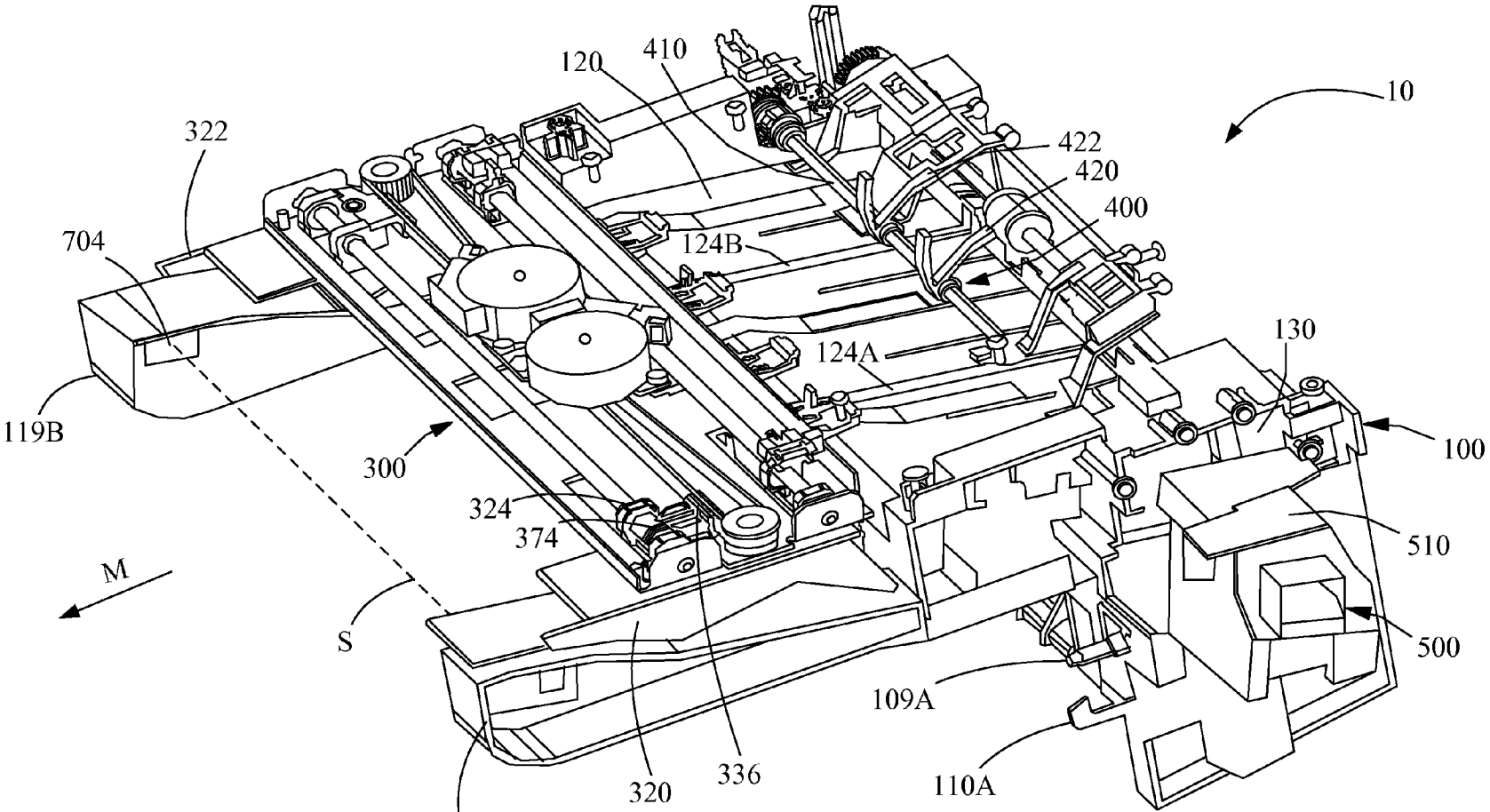
FIG. 8 is a perspective view of a stapler system according to one example embodiment.
Figure 9:
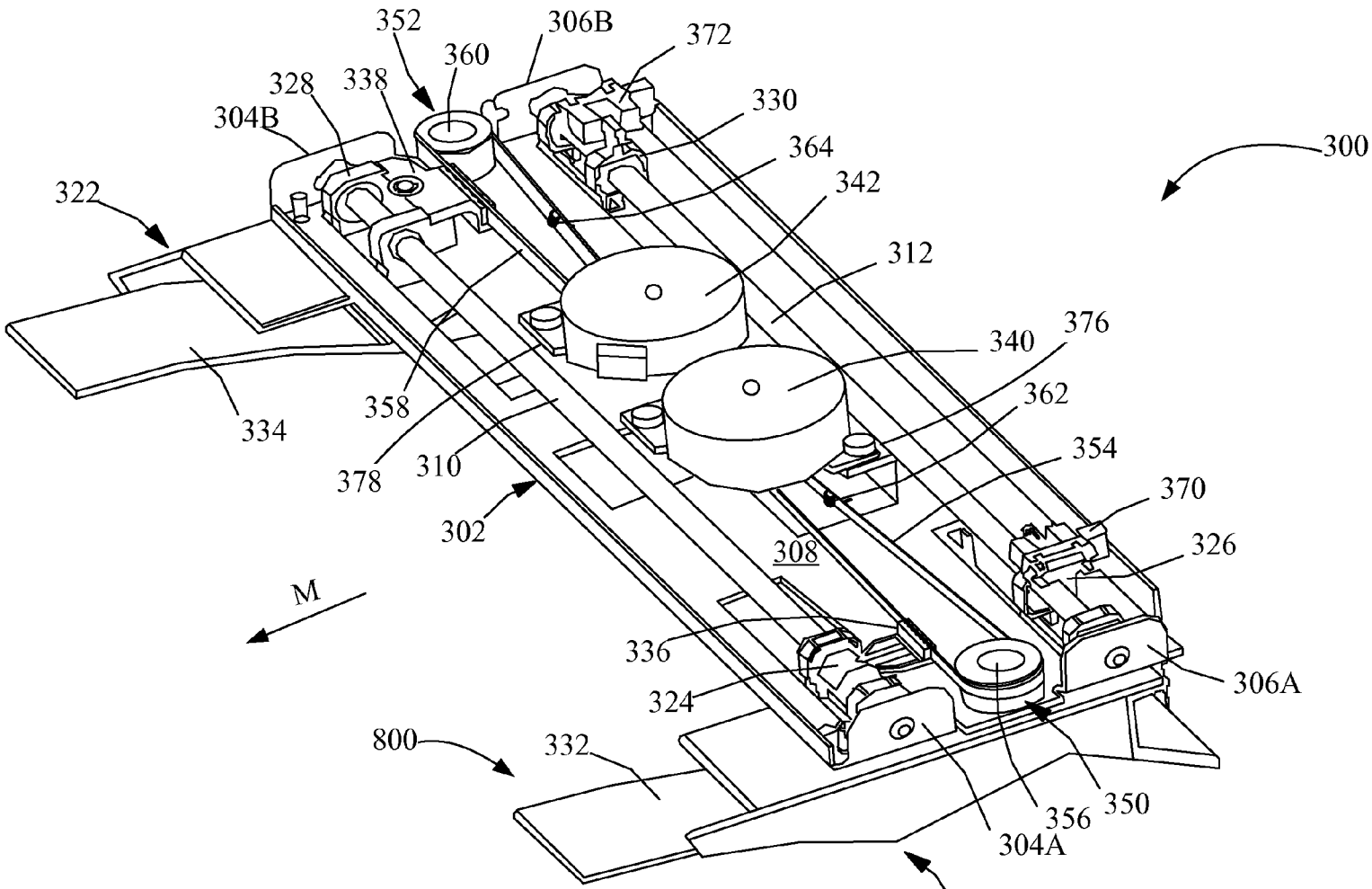
FIG. 9 is a perspective view of a first alignment mechanism of a stapler system according to one example embodiment.

Referring now to FIGS. 8 and 9, one example embodiment of first alignment mechanism 300 is shown in greater detail. However, it will be appreciated that alternative designs may be used to laterally align the media as desired.

As shown in FIG. 9, first alignment mechanism 300 includes a support frame 302. Support frame 302 mounts within housing 100. For example, support frame 302 may be mounted on portion 118 of housing 100. First alignment mechanism 300 also includes a pair of spaced apart and parallel support shafts 310, 312 carried by support frame 302. Specifically, support shaft 310 mounts between side flanges 304A, 304B of support frame 302 while support shaft 312 mounts between side flanges 306A, 306B.

First alignment mechanism 300 also includes a pair of spaced apart and parallel arms 320, 322 each slidably carried by support shafts 310, 312. Specifically, arms 320, 322 each include a pair of sliding connectors slidably coupled with support shafts 310, 312. For example, arm 320 includes a pair of sliding connectors 324, 326 slidably carried on one end of support shafts 310, 312, respectively. Similarly, arm 322 includes a pair of sliding connectors 328, 330 slidably carried on the other end of support shafts 310, 312, respectively. Each arm 320, 322 also includes a tamper portion coupled to the pair of sliding connectors thereof. For example, arm 320 includes a tamper portion 332 coupled to sliding connectors 324, 326 and arm 322 includes a tamper portion 334 coupled to sliding connectors 328, 330.

First alignment mechanism 300 further includes a pair of motors 340, 342, each of which may be, for example, a stepper motor. Motors 340, 342 mount on a top surface 308 of support frame 302. Motors 340, 342 may mount on top surface 308 with the help of mounting brackets 376, 378, respectively, and attachment means, such as nuts and bolts. Motors 340, 342 are operatively coupled with arms 320, 322, respectively, for slidably moving arms 320, 322 along support shafts 310, 312. In the example embodiment illustrated, first alignment mechanism 300 includes belt and pulley arrangements 350, 352 which operatively couple respective motors 340, 342 with respective arms 320, 322.

Belt and pulley arrangement 350 includes a belt 354 and a pulley 356 and belt and pulley arrangement 352 includes a belt 358 and a pulley 360. Pulleys 356, 360 are is rotably mounted on top surface 308 of support frame 302. Pulley 356 rotably mounts on top surface 308 between side flanges 304A, 306A of support frame 302. Similarly, pulley 360 rotably mounts on top surface 308 between side flanges 304B, 306B of support frame 302.

Belts 354, 358 of belt and pulley arrangements 350, 352 operatively couple pulleys 356, 360 with motors 340, 342, respectively. Specifically, belt 354 encircles pulley 356 and rotably couples with a drive shaft of motor 340 such that when the drive shaft of motor 340 rotates, belt 354 moves linearly and pulley 356 rotates. Similarly, belt 358 encircles pulley 360 and rotably couples with a drive shaft of motor 342 allowing belt 354 to move linearly and pulley 356 to rotate when the drive shaft of motor 342 rotates.

Belt and pulley arrangements 350, 352 also include belt tension springs 362, 364, respectively, carried by belts 354, 358, respectively. Belt tension springs 362, 364 respectively tension belts 354, 358 to reduce slack and prevent slipping of belts 354, 358.

As explained herein, belt and pulley arrangements 350, 352 couple motors 340, 342 with arms 320, 322, respectively. Arm 320 operatively couples with motor 340 via belt 354 and arm 322 operatively couples with motor 342 via belt 358. In the example embodiment illustrated, arm 320 includes a clamp 336 that is slidably carried by support shaft 310 and coupled to sliding connector 324, as shown in FIG. 9. Clamp 336 is further coupled to a portion of belt 354 such that when belt 354 is moved linearly due to the rotation of the drive shaft of motor 340, sliding connector 324 slides on support shaft 310 slidably moving arm 320 on support shaft 310 transverse to the media feed direction indicated by arrow M. Similarly, arm 322 includes a clamp 338 coupled to sliding connector 328 and belt 358 for slidably moving arm 322 on support shaft 310 transverse to the media feed direction M when belt 358 is moved linearly by motor 342.

First alignment mechanism 300 also includes sensors 370, 372 carried by arms 320, 322, respectively, on sliding connectors 326, 330, respectively. Sensors 370, 372 are communicably coupled with pass through sensor 220 mounted on media sheet path 210. Sensors 370, 372 determine the positions of arms 320, 322 on support shafts 310, 312, which will be explained in greater detail later herein.

First alignment mechanism 300 of stapler system 10 laterally aligns the printed media sheets. Specifically, arms 320, 322 each may slidably move towards each other for laterally aligning the printed media sheets on a collection tray 120 (shown in FIGS. 7 and 8) of housing 100. For example, when the printed media sheets follow media is sheet path 210 (as explained in conjunction with FIG. 7), the printed media sheets may be partially received on collection tray 120 and partially received on tamper portions 332, 334 of arms 320, 322. Specifically, when the leading edge of a printed media sheet is detected by pass through sensor 220, arms 320, 322 slidably move toward each other from a home position to a standby position to allow tamper portions 332, 334 to partially receive the printed media sheet thereon.

Figure 10:
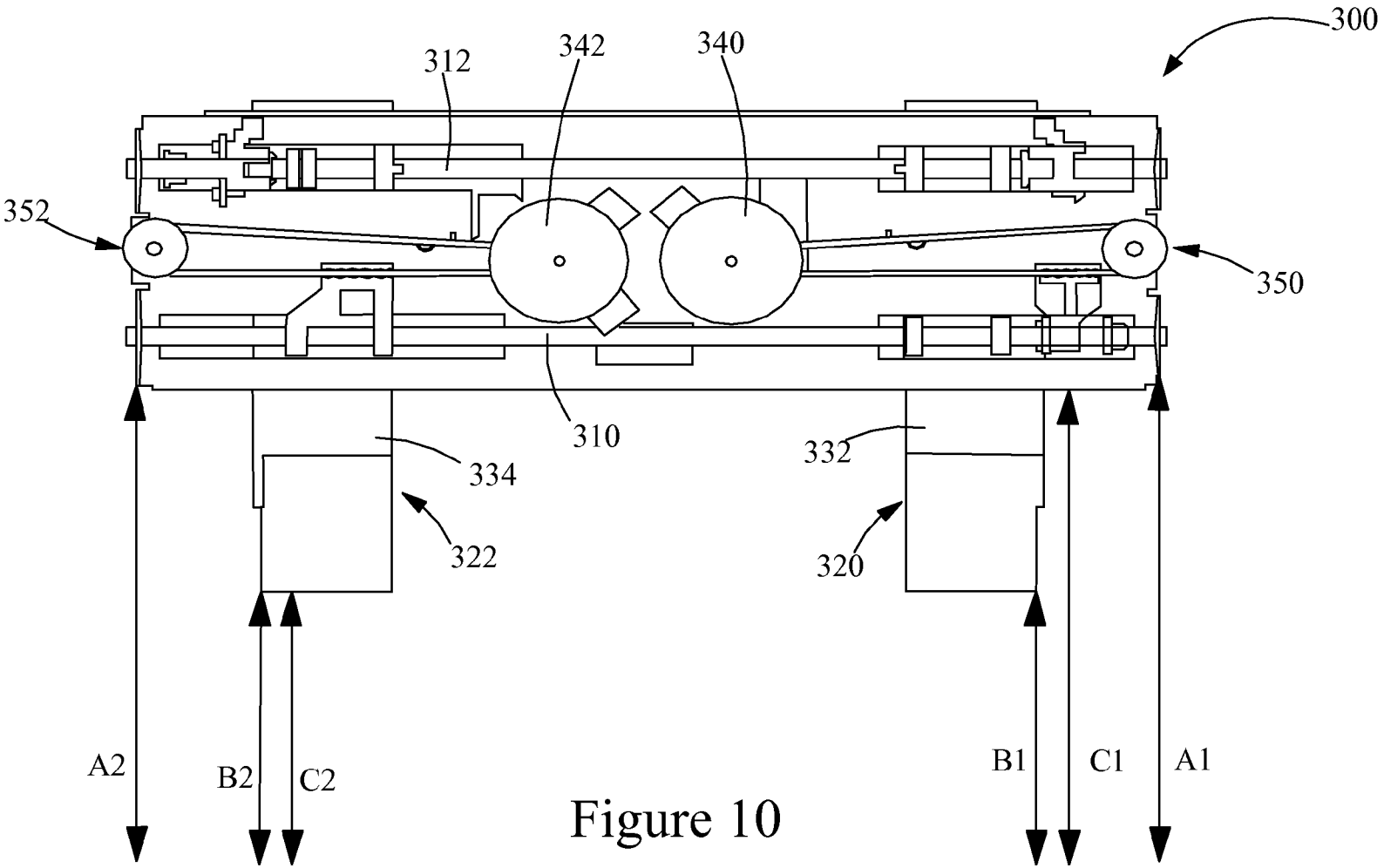
FIG. 10 is a top plan view of a first alignment mechanism of a stapler system according to one example embodiment.

Referring now to FIG. 10, a top view of first alignment mechanism 300 is shown. FIG. 10 also depicts the sequential positions of arms 320, 322 for laterally aligning the printed media sheets on collection tray 120. FIG. 10 depicts reference lines A1 and A2, showing the home position of arms 320, 322, respectively. In the home position A1, A2, the distance between arms 320, 322 is wider than the largest desirable media such that when arms 320, 322 are in the home position A1, A2, finished media may be passed between tamper portions 332, 334 to the output bin. Reference lines B1 and B2 show a standby position of arms 320, 322, respectively. References lines C1 and C2 show a stapling position of arms 320, 322, respectively. In the standby and stapling positions B1, B2 and C1, C2, the distance between arms 320, 322 is slightly larger than the width of the printed media sheets in order to laterally align the media sheets for stapling. Accordingly, it will be appreciated that the standby and stapling positions B1, B2 and C1, C2 depend on the size of the media.

When the leading edge of a printed media sheet is detected by pass through sensor 220, the controller directs arms 320, 322 to laterally slide from the home position A1, A2 to the standby position B1, B2 to receive the printed media sheet. It will be appreciated that the distance from the home position A1, A2 to the standby position B1, B2 is dependent upon the size of the media. For example, the distance from the home position A1, A2 to the standby position B1, B2 for A4 size media is greater than for A3 size media. In one example embodiment, in the case of letter size media, arms 320, 322 each travel about 37.5 mm toward each other on support shafts 310, 312, respectively, to reach the standby position B1, B2 from the home position A1, A2. In some embodiments, after each media sheet is received by arms 320, 322, arms 320, 322 laterally slide toward each other until the distance between arms 320, 322 is approximately equal to the width of the media and then slide away from each other to the standby position B1, B2 in order to laterally align the stack of printed media sheets. Alternatives include those wherein only one arm 320 or 322 laterally slides toward the other and then returns to the standby position in order to align the media. In the example embodiment illustrated, sliding connector 324 includes a spring 374 (FIG. 8) that allows arm 320 to over-tamper the media. In this embodiment, after each media sheet is received by arms 320, 322, sliding connector 324 travels slightly further than is required to laterally slide arm 320 a distance from arm 322 equal to the width of the media. Spring 374 permits arm 320 to travel far enough to laterally align the printed media sheets but prevents arm 320 from compressing the media. It will be appreciated that sliding connector 326 may also include a spring to permit over-tampering as desired.

Once the stack of printed media sheets is ready for stapling, arms 320, 322 laterally slide in parallel from the standby position B1, B2 to the stapling position C1, C2. In one example embodiment, in the case of letter size media, arms 320, 322 slide 10 mm from the standby position B1, B2 to the stapling position C1, C2. When stapling is complete, arms 320, 322 laterally slide away from each other to the home position A1, A2 in order to drop the stapled media to the output bin, such as output bin 1012 of image forming apparatus 1000, which will be explained in greater detail later herein.

Figure 11:
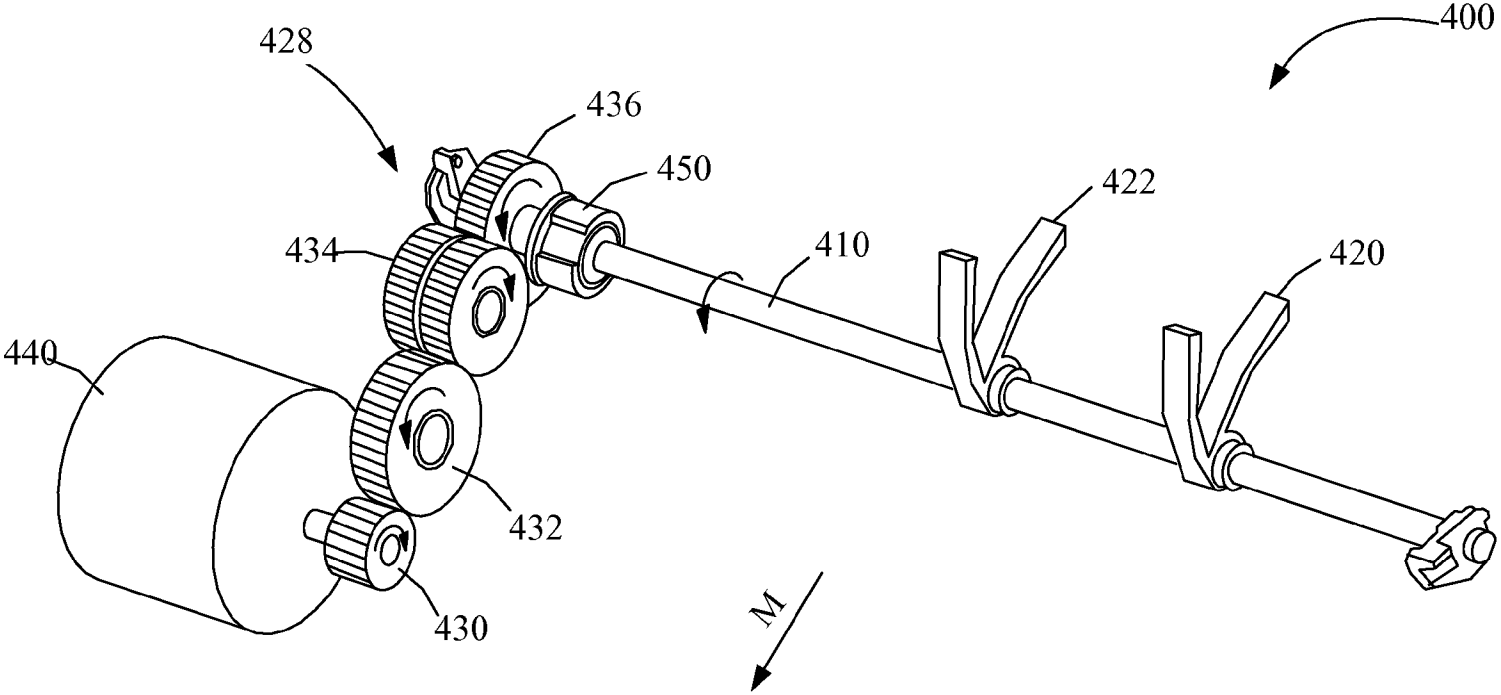
FIG. 11 is perspective view of a second alignment mechanism of a stapler system according to one example embodiment.

Referring now to FIG. 11, one example embodiment of a second alignment mechanism 400 of stapler system 10 for longitudinally aligning the printed media sheet is shown. However, it will be appreciated that alternative designs may be used to longitudinally align the media as desired. Second alignment mechanism 400 operatively mounts within housing 100, best shown in FIG. 7. As shown in FIG. 11, second alignment mechanism 400 includes a first shaft 410 extending transversely across a portion of media sheet path 210. First shaft 410 rotably mounts within housing 100, as shown in FIG. 8. Second alignment mechanism 400 also includes flexible paddle elements 420 and 422 carried by first shaft 410. Paddle elements 420, 422 are positioned above collection tray 120 of housing 100, as shown in FIG. 8. Paddle elements 420, 422 rotate with the rotation of first shaft 410.

Second alignment mechanism 400 includes a motor 440 and a first drive transmission 428 that operatively couples motor 440 to second alignment mechanism 400. First drive transmission 428 includes a first set of gears 430, 432, 434 and 436 and first shaft 410, as shown in FIG. 11. First set of gears 430, 432, 434, 436 operatively couples with first shaft 410. Specifically, gear 436 is carried by first shaft 410, such that rotation of gear 436 rotates first shaft 410. As illustrated, motor 440 is a stepper motor. Motor 440 operatively couples with first set of gears 430, 432, 434, 436. Specifically, gear 430 is mounted on a shaft (not shown) of motor 440. Therefore, motor 440 rotates first shaft 41° through first set of gears 430, 432, 434, 436. Specifically, rotation of the shaft of motor 440 rotates gear 430, which in turn rotates gears 432, 434, 436 for rotating first shaft 410. It will be appreciated that the number and orientation of the gears of first drive transmission 428 illustrated and described herein is meant to serve as an example and is not intended to be limiting.

Rotation of first shaft 410 allows paddle elements 420, 422 to longitudinally align the media sheets on collection tray 120 of housing 100. More specifically, once a media sheet is laterally aligned by first alignment mechanism 300 (as explained in conjunction with the FIGS. 9 and 10), thereafter the media sheet is longitudinally aligned on collection tray 120 by second alignment mechanism 400, which will be explained in greater detail later herein. Second alignment mechanism 400 also includes a first one way clutch 450 carried by first shaft 410, as shown in FIG. 11. Alternatives include those wherein first one way clutch 450 is positioned on one of the first set of gears 430, 432, 434, 436. When motor 440 is rotating in a first direction, first one way clutch 450 engages and allows the rotation of first shaft 410. When motor 440 is rotating in a second direction, first one way clutch 450 disengages and restricts the rotation of first shaft 410.

Motor 440 rotates in the first direction (clockwise in FIG. 11), which rotates first shaft 410 in a first direction (counter-clockwise in FIG. 11) due to a rotation provided by first set of gears 430, 432, 434, 436. Further, rotation of first shaft 410 in the first direction rotates paddle elements 420, 422 in the first direction. The rotation of paddle elements 420, 422 in the first direction allows paddle elements 420, 422 to contact the surface of a printed media sheet placed on collection tray 120. The contact of paddle elements 420, 422 moves the media sheet rearward, such that a trailing edge of the media sheet touches a wall 122 (shown in FIG. 7) of collection tray 120. As a result, the printed media sheet is longitudinally aligned by second alignment mechanism 400 on collection tray 120.

Accordingly, subsequent printed media sheets may be laterally and longitudinally aligned by first alignment mechanism 300 and second alignment mechanism 400 for configuring a stack of aligned media sheets on collection tray 120. Further, it will be appreciated by those skilled in the art that printed media sheet may be initially longitudinally aligned by second alignment mechanism 400 on collection tray 120 and thereafter laterally aligned by first alignment mechanism 300.

Referring back to FIG. 8, stapler system 10 also includes staple head 500 for stapling the stack of laterally and longitudinally aligned printed media sheets. Staple head 500 is mounted within housing 100 and positioned along a side of housing 100. As shown in FIG. 8, staple head 500 is slidably received by a side slot 130 of housing 100. Thereafter, staple head 500 is mounted within side slot 130 with the help of a mounting bracket 510 and attachment means, such as screws (not shown). Further, staple head 500 may be mounted within side slot 130 of housing 100 such that staple head 500 is aligned to the reference line C1 (shown in FIG. 10) to allow staple head 500 to staple the stack of media sheets after being laterally and longitudinally aligned by first alignment mechanism 300 and second alignment mechanism 400, respectively.

Figure 12:
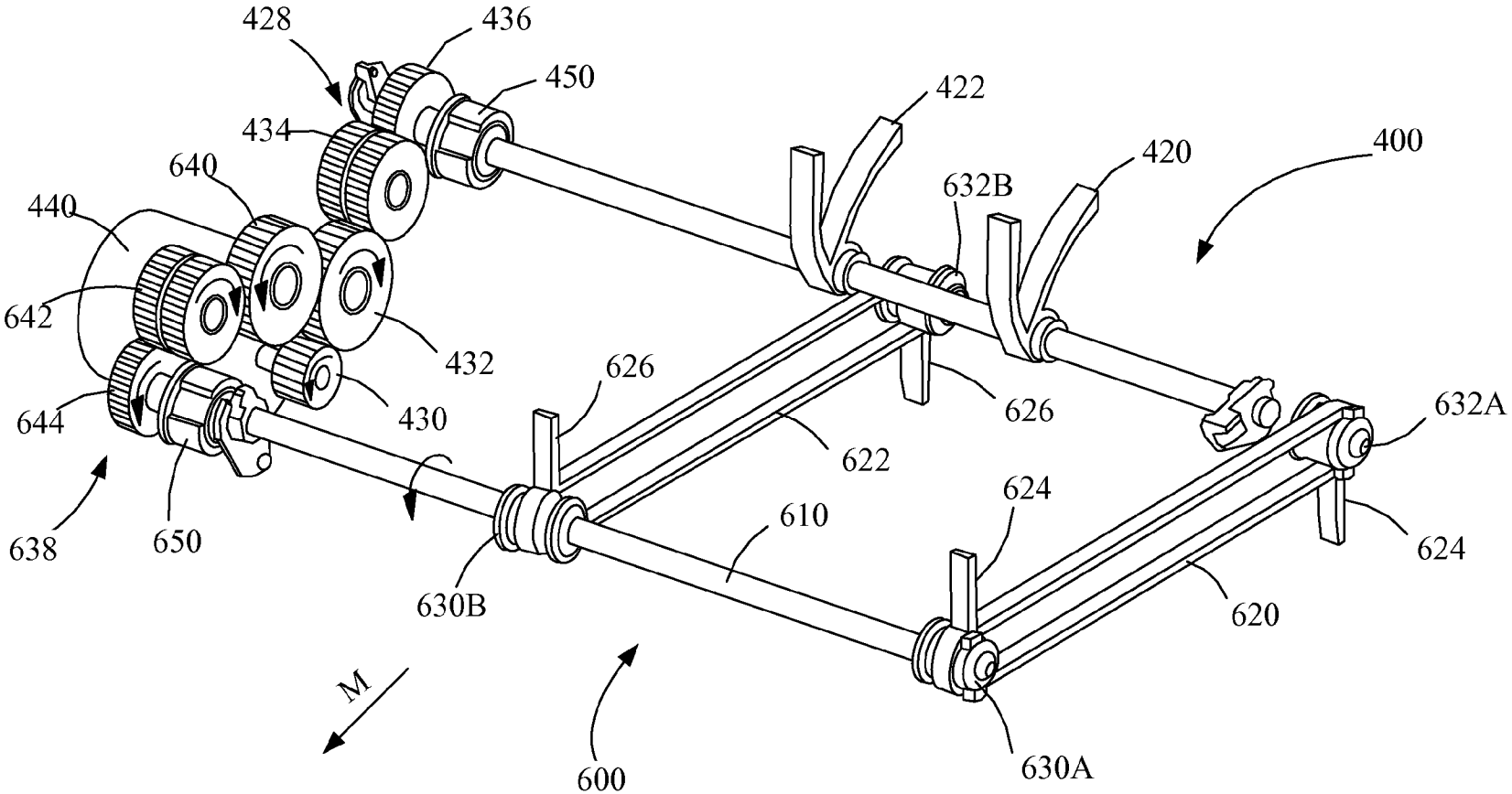
FIG. 12 is a perspective view of an ejection mechanism along with a second alignment mechanism of a stapler system according to one example embodiment.

Referring now to FIG. 12, a perspective view of an ejection mechanism 600 of stapler system 10 is shown along with second alignment mechanism 400. Ejection mechanism 600 includes a second shaft 610 that rotably mounts within housing 100. Ejection mechanism 600 includes spaced apart ejector belts 620 and 622 rotably mounted on second shaft 610 with pulley members 630A, 630B that are mounted on housing 100. Pulley members 632A, 632B are respectively aligned with pulley members 630A, 630B. Ejector belt 620 mounts on pulley members 630A, 632A while ejector belt 622 mounts on pulley members 630B, 632B. Rotation of second shaft 610 rotates ejector belts 620, 622.

Ejector belts 620, 622 move along collection tray 120 of housing 100 along 30 media sheet path 210. Collection tray 120 may have longitudinal channels 124 (shown in FIG. 8), which facilitate the movement of the pair of ejector belts 620, 622 along collection tray 120. Parallel longitudinal channels 124A, 124B receive projections 624 and 626 (shown in FIG. 12) on the outer surface of ejector belts 620, 622.

Ejection mechanism 600 also includes a second drive transmission 638 that operatively couples ejection mechanism 600 with motor 440 of second alignment mechanism 400. Second drive transmission 638 includes a second set of gears 640, 642 and 644 and second shaft 610. Second set of gears 640, 642 and 644 are operatively coupled to second shaft 610. Specifically, gear 644 is carried by second shaft 610. Second shaft 610 is rotated by motor 440 through the second set of gears 640, 642, 644. Specifically, gear 640 meshes with gear 432 for receiving torque from motor 440. It will be appreciated that the number and orientation of the gears of second drive transmission 638 illustrated and described herein is meant to serve as an example and is not intended to be limiting.

Ejection mechanism 600 also includes a second one way clutch 650 carried by second shaft 610. Alternatives include those wherein second one way clutch 650 is positioned on one of the second set of gears 640, 642, 644. When motor 440 is rotating in the first direction (clockwise direction in FIGS. 11 and 12), second one way clutch 650 disengages and restricts rotation of second shaft 610 in a first direction. When motor 440 is rotating in the second direction (counter-clock direction in FIGS. 11 and 12), second one way clutch 650 engages and allows rotation of second shaft 610 in a second direction.

Ejection mechanism 600 facilitates moving the stapled media sheets from collection tray 120 towards first alignment mechanism 300, particularly towards tamper portions 332, 334 of arms 320, 322, respectively. Specifically, when motor 440 rotates in the second direction (counter-clockwise direction shown with an arrow in FIGS. 11 and 12), second shaft 610 also rotates (counter-clockwise shown with an arrow in FIGS. 11 and 12) due to a rotation provided by the second set of gears 640, 642, 644. Due to rotation of second shaft 610, ejector belts 620, 622 also rotate which moves projections 624, 626 in the media feed direction M to move the stack of stapled media sheets from collection tray 120 towards tamper portions 332, 334 of arms 320, 322. Specifically, projections 624, 626 move within their respective channels 124A, 124B of collection tray 120 for moving the stack of stapled media sheets from collection tray 120 towards tamper portions 332, 334 of first alignment mechanism 300.

The stack of stapled media sheets is now received on tamper portions 332, 334 of first alignment mechanism 300 for being collected into an output bin of an image forming apparatus, such as output bin 1012 of image forming apparatus 1000. More specifically, when ejection mechanism 600 moves the stack of stapled media sheets towards tamper portions 332, 334 of arms 320, 322, arms 320, 322 are allowed to move away from each other. For example, arms 320, 322 are allowed to attain the home position (shown with the reference lines A1 and A2), thereby allowing tamper portions 332, 334 of arms 320, 322 to leave the stack of stapled media sheets allowing the stapled media sheet to fall into an output bin of an image forming apparatus, such as output bin 1012 of image forming apparatus 1000. Accordingly, in the example embodiment illustrated, arms 320, 322, and more specifically tamper portions 332, 334, serve as media release mechanism 800 (FIG. 9) that delivers stapled media from housing 100 to the output bin of the image forming apparatus. However, it will be appreciated that any suitable device for releasing stapled media from housing 100 and delivering it to the output bin may be utilized such as, for example, a conventional exit nip formed between a pair of exit rollers or a device similar to ejection mechanism 600.

Figure 13:
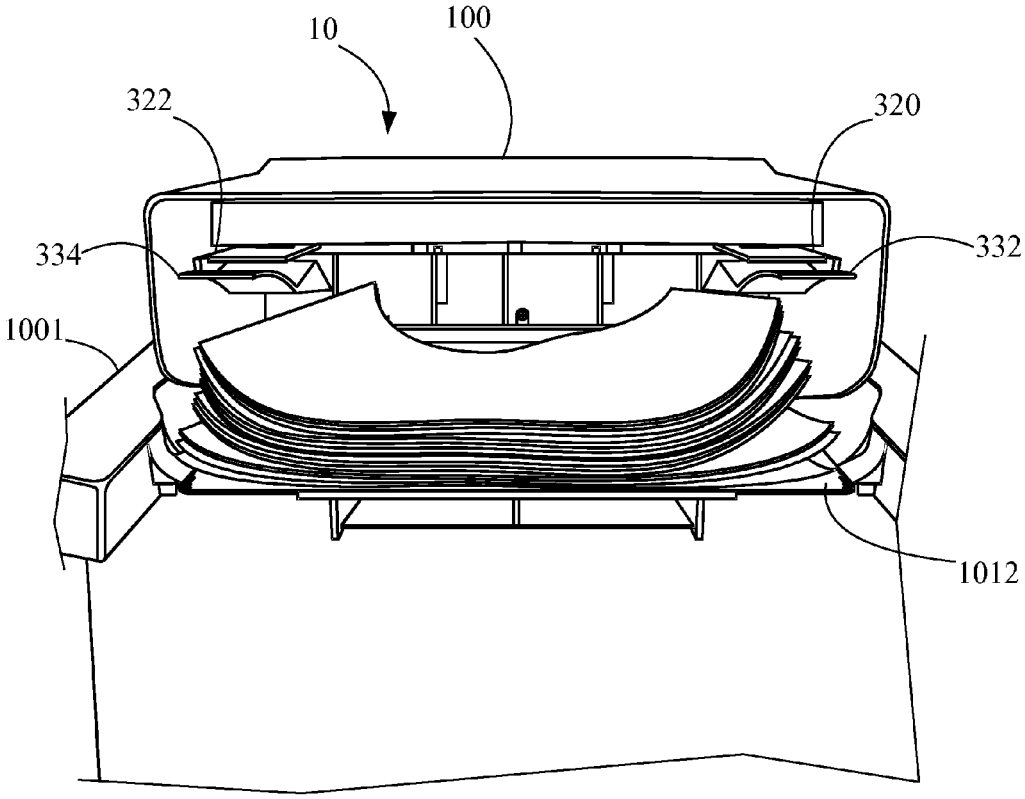
FIG. 13 is a perspective view of an output bin of an image forming apparatus having a stapler system mounted thereon.

Stapler system 10 of the present disclosure also includes sensors for detecting a height of the stack of printed media sheets to be collected on tray 120 and a height of the stack of stapled media sheets to be collected in an output bin, such as output bin 1012. For example, stapler system 10 includes sensors 702, 704 positioned on housing 100, as shown in FIG. 7. Sensor 702 detects a height of a stack of printed media sheets on tray 120. Sensor 704 detects a height of a stack of media sheets in an output bin, such as output bin 1012 (FIGS. 4 and 8). In the example embodiment illustrated, sensor 704 is an optical sensor that includes a transmitter and a receiver that form an optical path S therebetween. The transmitter and the receiver are positioned on opposite portions 119A, 119B of housing 100, respectively. In the example embodiment illustrated, portions 119A, 119B are positioned in a stationary manner beneath arms 320, 322, respectively. FIG. 13 shows output bin 1012 having printed media therein. In some instances, printed media may tend to curl as shown in FIG. 13. If the height of the stack of media in output bin 1012 gets too high, it may interfere with the movement of arms 320, 322. Accordingly, sensor 704 detects whether the stack of media sheets in an output bin, such as output bin 1012, exceeds a predetermined height that could restrict the movement of arms 320, 322. If sensor 704 detects the presence of media, the image forming apparatus indicates to the user that the media in the output bin needs to be removed. This indication may be in the form of a message on a display screen of the image forming apparatus, such as a display device 2020 of image forming apparatus 2000 (FIG. 2), or a signal from an indicator light (not shown).

Referring now to FIG. 7, in use, initially, diverter 202 allows a printed media sheet (not shown) to enter housing 100 of stapler system 10. Thereafter, feed rollers 204 guide the printed media sheet along media sheet path 210. Once pass through sensor 220 detects a leading edge of the printed media sheet, first alignment mechanism 300 and second alignment mechanism 400 are triggered by pass through sensor 220. Specifically, in one embodiment, when the leading edge of the printed media sheet moves 160 mm in about 542 ms (millisecond), arms 320, 322 move from the home position (shown with reference lines A1, A2 in FIG. 10) to the standby position (shown with reference lines B1, B2 in FIG. 10). Thereafter, when a trailing edge of the printed media sheet is detected by pass through sensor 220, the printed media sheet is allowed to move along the media sheet path 210 for about 91 ms. This allows the printed media sheet to be received on collection tray 120. Once the printed media sheet is received on collection tray 120, second alignment mechanism 400 is allowed to operate for about 172 ms. Specifically, motor 440 is allowed to rotate first shaft 410 for about 172 ms, thereby allowing paddle elements 420, 422 to move the printed media sheet rearwardly for contacting wall 122 of collection tray 120. This allows the printed media sheet to be longitudinally aligned in collection tray 120. Further, arms 320, 322 move towards each other from the standby position (shown with reference lines B1, B2 in FIG. 10) for laterally aligning the media sheet on collection tray 120. Specifically, after 129 ms, when the printed media sheet is longitudinally aligned, arms 320, 322 move towards each other, for example with reference to the FIG. 10, arms 320, 322 move 5 mm towards each other for laterally aligning the media sheet on collection tray 120. Accordingly, the printed media sheet is laterally and longitudinally aligned on collection tray 120 by first alignment mechanism 300 and second alignment mechanism 400.

Once the printed media sheet is laterally and longitudinally aligned on collection tray 120, arms 320, 322 move away from each other, particularly towards the standby position (shown with reference lines B1, B2 in FIG. 10). Thereafter, a next printed media sheet is allowed to move along the media sheet path 210 for being collected on collection tray 120, thereafter next printed media sheet is laterally and longitudinally aligned on collection tray 120 by first alignment mechanism 300 and second alignment mechanism 400. Accordingly, subsequent printed media sheets are received on collection tray 120 and thereafter laterally and longitudinally aligned for configuring a stack of aligned printed media sheets on collection tray 120.

Once the stack of aligned printed media sheets is configured on collection tray 120, arms 320, 322 move from the standby position (shown with reference lines B1, B2 in FIG. 10) to the stapling position (shown with reference lines C1, C2 in FIG. 10). Thereafter, staple head 500 is actuated to perform the stapling function for stapling the stack of aligned printed media sheets. Next, arms 320, 322 move away for each other, i.e., from the stapling position towards the standby position. Thereafter, ejection mechanism 600 is triggered for moving the stack of stapled media sheets towards tamper portions 332, 334 of arms 320, 322. Finally, arms 320, 322 move from the standby position to the home position allowing the stack of stapled media sheets to collect into an output bin of an image forming apparatus, such as output bin 1012 of image forming apparatus 1000.

The present disclosure provides a stapler system, such as the stapler system 10, for an image forming apparatus, such as a SFP and a MFP. The stapler system of the present disclosure obtains an aligned stack of stapled media sheets. The stapler system mounts on a conventional image forming apparatus. The stapler system shares an existing output bin of an image forming apparatus thereby avoiding the need for a separate tray for collecting the stack of stapled media sheets. The stapler system of the present disclosure conveniently mounts on a MFP without increasing a distance between a scanner portion and a base portion of the MFP.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A stapler system for an image forming apparatus, comprising:

a housing having a generally L-shaped structure formed by a first portion and a second portion extending in a generally orthogonal direction from the first portion;

a mounting device on a front portion of the first portion for removably mounting the housing to a vertically extending wall of the image forming apparatus so that the front portion of the first portion of the housing faces the vertically extending wall of the image forming device when the housing is mounted on the image forming apparatus;

a staple head positioned within the housing for stapling media;

a media sheet path within the housing for directing media received from the image forming apparatus to the staple head for stapling, the media sheet path having a media entrance in the front portion of the first portion of the housing for receiving the media through an opening in the vertically extending wall of the image forming apparatus; and a media release mechanism on the second portion of the housing for delivering stapled media from the housing to the output bin of the image forming apparatus, the media release mechanism configured to extend above an output bin of the image forming apparatus when the housing is mounted on the image forming apparatus.

2. The stapler system of claim 1, wherein the media sheet path is generally C-shaped.

3. The stapler system of claim 1, wherein the mounting device includes a movable latch member for securing the housing to the image forming apparatus, the latch member being received by a corresponding opening in the image forming apparatus when the housing is mounted on the image forming apparatus.

4. The stapler system of claim 3, wherein the mounting device includes a pin adjacent to the latch member for aligning the housing with the image forming apparatus, the pin being received by a corresponding hole in the image forming apparatus when the housing is mounted on the image forming apparatus.

5. The stapler system of claim 3, further comprising a biasing member that biases the latch member toward a locked position where the latch member is engaged with a catch of the image forming apparatus when the housing is mounted on the image forming apparatus.

6. The stapler system of claim 5, further comprising the mounting device including an actuating mechanism having a latch that is operatively coupled to the latch member, wherein pressing the latch releases the latch member from the locked position and permits removal of the housing from the image forming apparatus.

7. The stapler system of claim 6, wherein pressing the latch causes the latch member to pivot about a pivot point and clear the catch of the image forming apparatus thereby releasing the latch member from the locked position.

8. The stapler system of claim 6, wherein the latch faces the vertically extending wall of the image forming apparatus when the housing is mounted on the image forming apparatus.

9. The stapler system of claim 1, wherein when the housing is mounted on a multi-function image forming apparatus having a base portion for printing, a scanner portion for scanning and a gap formed between the base portion and the scanner portion and having the output bin positioned in the gap, the second portion of the housing extends into the gap and above the output bin.

10. An image forming apparatus, comprising:

a body having:

a base portion for printing having an output bin positioned on a top portion thereof for receiving printed media;

a scanner portion for scanning connected to and positioned above the base portion; and a gap formed between the base portion and the scanner portion, the output bin being positioned in the gap; and a stapler system having:

a housing removably mounted to the body;

a mounting device for mounting the housing to the image forming apparatus;

a staple head positioned within the housing for stapling media; and a media sheet path within the housing positioned to receive printed media from the base portion of the body and to direct the printed media received from the body to the staple head for stapling;

wherein a portion of the housing extends into the gap and above the output bin to permit delivery of stapled media from the housing to the output bin.

11. The image forming apparatus of claim 10, wherein a front portion of the housing of the stapler system is removably mounted to and faces a vertically extending wall of the base portion of the body.

12. The image forming apparatus of claim 10, wherein the media sheet path within the housing of the stapler system is positioned to receive the printed media through an opening in a vertically extending wall of the base portion of the body.

13. A stapler system for an image forming apparatus, comprising:

a housing having a front portion;

a mounting device on the front portion of the housing for mounting the housing to a generally vertical wall of the image forming apparatus, the front portion facing the generally vertical wall of the image forming apparatus when the housing is mounted on the image forming apparatus;

a staple head positioned within the housing for stapling media; and a generally C-shaped media sheet path within the housing for directing media to the staple head for stapling, the media sheet path having a media sheet entrance on the front portion of the housing for receiving media through an opening in the generally vertical wall of the image forming apparatus;

wherein a portion of the housing is configured to extend above an output bin of the image forming apparatus when the housing is mounted on the image forming apparatus to permit delivery of stapled media from the housing to the output bin of the image forming apparatus.

14. The stapler system of claim 13, further comprising an inlet for receiving power from a power source and an outlet for supplying power to the image forming apparatus.

15. The stapler system of claim 14, further comprising a retaining member adjacent to the inlet for retaining a power cord connected to the inlet, the retaining member having an opening therein for receiving the power cord therethrough, a first end and a second end, wherein at least one of the first end and the second end of the retaining member is removably attached to the housing.

16. The stapler system of claim 15, wherein at least one of the first end and the second end of the retaining member includes an opening for receiving a peg extending from the housing for removably attaching the at least one of the first end and the second end to the housing.

17. The stapler system of claim 13, further comprising a first alignment mechanism for laterally aligning media sheets to be stapled having a pair of arms that are slidably movable relative to each other, the arms being positioned above the output bin of the image forming apparatus when the housing is mounted on the image forming apparatus, wherein the arms are slidable toward each other to laterally align the media sheets and away from each other to release the media sheets to the output bin of the image forming apparatus.

18. The stapler system of claim 17, further comprising a sensor positioned on a portion of the housing beneath the pair of arms for detecting whether media in the output bin of the image forming apparatus exceeds a predetermined height.

19. The stapler system of claim 17, further comprising:

a motor;

a second alignment mechanism for longitudinally aligning the media sheets on a collection tray, the second alignment mechanism being operatively coupled to the motor by a first drive transmission having a first one way clutch; and an ejection mechanism for ejecting the media sheets from the collection tray to the arms of the first alignment mechanism, the ejection mechanism being operatively coupled to the motor by a second drive transmission having a second one way clutch;

wherein when the motor rotates in a first direction, the first one way clutch is engaged causing the second alignment mechanism to longitudinally align the media sheets and the second one way clutch is disengaged to restrict the ejection mechanism from ejecting the media sheets and when the motor rotates in a second direction opposite the first direction, the first one way clutch is disengaged to restrict the second alignment mechanism from longitudinally aligning the media sheets and the second one way clutch is engaged causing the ejection mechanism to eject the media sheets from the collection tray to the arms of the first alignment mechanism.

20. A stapler system for an image forming apparatus, comprising:

a housing having a generally L-shaped structure formed by a first portion and a second portion extending in a generally orthogonal direction from the first portion;

a mounting device on a front portion of the first portion for removably mounting the housing to a vertically extending wall of the image forming apparatus so that the front portion of the first portion of the housing faces the vertically extending wall of the image forming device when the housing is mounted on the image forming apparatus;

a staple head positioned within the housing for stapling media;

a media sheet path within the housing for directing media received from the image forming apparatus to the staple head for stapling; and a media release mechanism on the second portion of the housing for delivering stapled media from the housing to the output bin of the image forming apparatus, the media release mechanism configured to extend above an output bin of the image forming apparatus when the housing is mounted on the image forming apparatus, wherein the mounting device includes a movable latch member for securing the housing to the image forming apparatus, the latch member being received by a corresponding opening in the image forming apparatus when the housing is mounted on the image forming apparatus, wherein the mounting device includes a pin adjacent to the latch member for aligning the housing with the image forming apparatus, the pin being received by a corresponding hole in the image forming apparatus when the housing is mounted on the image forming apparatus.

21. A stapler system for an image forming apparatus, comprising:

a housing having a generally L-shaped structure formed by a first portion and a second portion extending in a generally orthogonal direction from the first portion;

a mounting device on a front portion of the first portion for removably mounting the housing to a vertically extending wall of the image forming apparatus so that the front portion of the first portion of the housing faces the vertically extending wall of the image forming device when the housing is mounted on the image forming apparatus;

a staple head positioned within the housing for stapling media;

a media sheet path within the housing for directing media received from the image forming apparatus to the staple head for stapling; and a media release mechanism on the second portion of the housing for delivering stapled media from the housing to the output bin of the image forming apparatus, the media release mechanism configured to extend above an output bin of the image forming apparatus when the housing is mounted on the image forming apparatus, wherein the mounting device includes a movable latch member for securing the housing to the image forming apparatus, the latch member being received by a corresponding opening in the image forming apparatus when the housing is mounted on the image forming apparatus; and further comprising a biasing member that biases the latch member toward a locked position where the latch member is engaged with a catch of the image forming apparatus when the housing is mounted on the image forming apparatus.

22. The stapler system of claim 21, further comprising the mounting device including an actuating mechanism having a latch that is operatively coupled to the latch member, wherein pressing the latch releases the latch member from the locked position and permits removal of the housing from the image forming apparatus.

23. The stapler system of claim 22, wherein pressing the latch causes the latch member to pivot about a pivot point and clear the catch of the image forming apparatus thereby releasing the latch member from the locked position.

24. The stapler system of claim 22, wherein the latch faces the vertically extending wall of the image forming apparatus when the housing is mounted on the image forming apparatus.

25. A stapler system for an image forming apparatus, comprising:

a housing having a generally L-shaped structure formed by a first portion and a second portion extending in a generally orthogonal direction from the first portion;

a mounting device on a front portion of the first portion for removably mounting the housing to a vertically extending wall of the image forming apparatus so that the front portion of the first portion of the housing faces the vertically extending wall of the image forming device when the housing is mounted on the image forming apparatus;

a staple head positioned within the housing for stapling media;

a media sheet path within the housing for directing media received from the image forming apparatus to the staple head for stapling; and a media release mechanism on the second portion of the housing for delivering stapled media from the housing to the output bin of the image forming apparatus, the media release mechanism configured to extend above an output bin of the image forming apparatus when the housing is mounted on the image forming apparatus, wherein when the housing is mounted on a multi-function image forming apparatus having a base portion for printing, a scanner portion for scanning and a gap formed between the base portion and the scanner portion and having the output bin positioned in the gap, the second portion of the housing extends into the gap and above the output bin.

* * * * *